United States Patent [19]

Eve et al.

[11] 3,942,008

[45] Mar. 2, 1976

[54] THERMAL IMAGING DEVICE

[75] Inventors: Clifford F. Eve, Murrysville; Max Garbuny, Pittsburgh, both of Pa.

[73] Assignee: The United States of America as represented by the Secretary of the Army, Washington, D.C.

[22] Filed: Dec. 23, 1974

[21] Appl. No.: 535,242

[52] U.S. Cl. ..... 250/332; 250/334; 250/342

[51] Int. Cl.[2] ..... H01J 31/49

[58] Field of Search ..... 250/332, 333, 334, 338, 250/342

[56] References Cited

UNITED STATES PATENTS

| | | | |
|---|---|---|---|
| 3,110,816 | 11/1963 | Kaisler et al. | 250/338 |
| 3,298,229 | 1/1967 | Klein | 250/338 |
| 3,364,066 | 1/1968 | Karlson et al. | 250/338 |
| 3,397,314 | 8/1968 | Weiner | 250/338 |

*Primary Examiner*—Harold A. Dixon

*Attorney, Agent, or Firm*—Nathan Edelberg; Robert P. Gibson; John E. Holford

[57] ABSTRACT

A unique imaging device operating in the far infrared is provided by utilizing fiber optic techniques. The system is used to improve the performance of photoconductive and thermoresistive type retinas.

7 Claims, 8 Drawing Figures

THERMAL IMAGING DEVICE

BACKGROUND OF INVENTION

The use of far infrared viewers for surveillance and diagnostic work has become popular because of their ability to detect targets by their temperature difference in comparison with local backgrounds. This difference in many cases is impossible to conceal, and in diagnostic studies is often more pertenant than any visual changes that occur. Originally photographic techniques were preferred because of their high resolution, but current needs are running to realtime devices employing electronic circuitry. Excellent devices have been fabricated using individual diodes to generate the point or line elements that make up the final image. The resolution achievable depends on the size of the diodes and efforts to meet even modest requirements have resulted in very expensive devices. A more economical approach is to provide an imaging device with a continuous layered film or retina having a response property that can be measured by projecting a narrow beam of electrons onto its surface. These latter devices can be divided into two groups depending on whether the retina has a photoconductive or a thermoresistive (bolometer) type of response property.

In both types the retina is cooled to provide the necessary sensitivity, usually to the temperature of liquid nitrogen, and a shield at the same temperature blocks out essentially all radiation except that from the object space of interest. This results in a retina that is deeply recessed and requires a lens system with a narrow field of view. Even with such precautions there is still the vignetting effect of the cosine law refraction, which produces a radial shading of the temperature image at the retina. Superposed on this same image is the ever-present nonuniformity of the retina itself, which can obscure the small variations that take place between adjacent points on the retina. Similar restrictions apply to devices with both types of retinas, so that the resolution of the two are approximately equal.

BRIEF DESCRIPTION OF INVENTION

An object of the present invention is to improve the quality of the continuous retina type far infrared viewing device by using a special bundle of optical fibers to process the image as it travels from the image plane to the plane of the retina.

BRIEF DESCRIPTION OF DRAWINGS

This and other objects of the invention will be best understood with reference to the accompanying drawings wherein.

DESCRIPTION OF THE INVENTION

Figure 1:
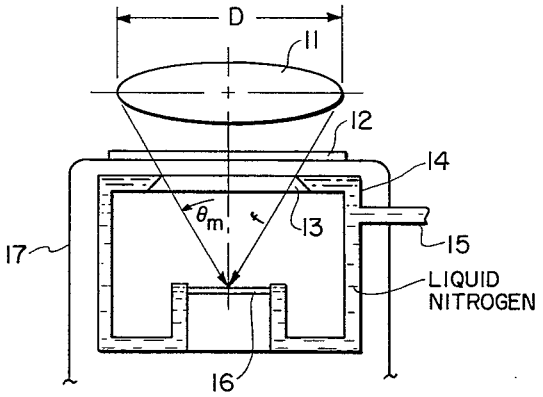
FIG. 1 (Prior Art)
FIG. 1 shows a side view in cross-section of a coldhead arrangement for a continuous retina tube according to the prior art.

Referring specifically to FIG. 1 there is shown a typical thermal imaging tube from the prior art. The lens 11 focusses an image through window 12 in the tube shell 17 and iris 13 in a cold head 14. The final image appears on a retina 16. The coldhead communicates through one or more tubulations 15 with a supply of liquid nitrogen. For best resolution the smallest possible iris is used and the greatest possible spacing between the iris and the retina. This leads to the use of expensive telescopic type lens systems.

Figure 2:
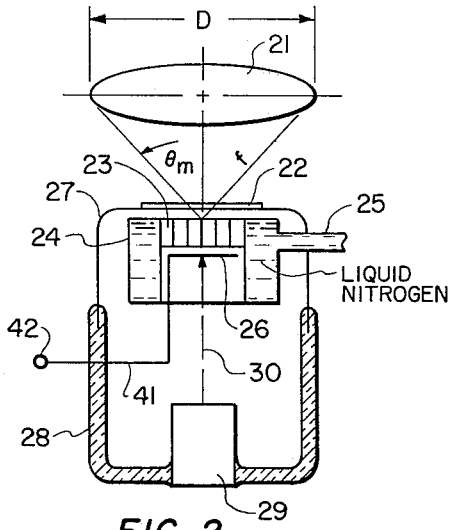
FIG. 2 shows a side view in cross-section of a continuous retina tube structure according to the present invention.

FIG. 2 shows a thermal imaging tube according to the present invention. It also has a lens system 21 and a tube window 22, but instead of an iris a short bundle of optical fibers 23 is used. The cold head 24 contacts and supports the fibers and has the usual one or more tubulations 25 communicating with an exterior supply of liquid nitrogen. The retina 26 is mounted in a spaced parallel relationship or attached to the inner ends of the optical fibers. This arrangement allows the image to be formed very close to the window 22, which in turn relieves the requirements of the lens system. The cold head is joined to window 22 by metal tube shell 27, which in turn is sealed to the glass body 28 of the tube. A conventional electron gun 29 is mounted through the glass body in the usual fashion. The electron beam 30 is directed onto the retina and the resulting signal is carried by lead 31 sealed through the glass body to an external terminal 32.

Figure 3:
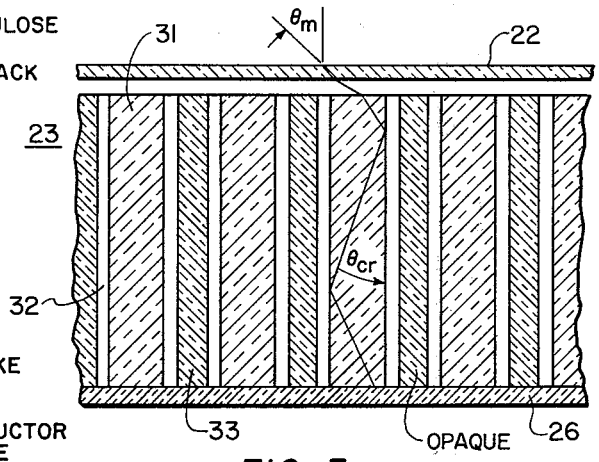
FIG. 3 is a more detailed side view in cross-section of the fiber optic bundle 23 used in the FIG. 2 structure.

Returning to the bundle of optical fibers, FIG. 3 shows the general relationship of the transparent fibers 31 which are typically 50 microns in diameter surrounded by air or a cladding layer 32 a few microns thick. Each fiber is separated from the next by opaque fibers 33 the function of which will be discussed in due course.

An image projected on the front end of this bundle is dissected and "piped" through individual fibers 31 and then projected on the retina 26 which is in close proximity to the back end of the bundle. If the fibers 31 of index of refraction $n_1$ are surrounded by a cladding 32 of the smaller index $n_2$, far infrared rays incident on the walls at an angle of incidence larger than the critical angle for total reflection will be transmitted through the light pipes with an absorption which is small. Providing of course the fiber itself is made from a low loss material, such as arsenic trisulfide. The critical angle $\theta_{cr}$ will be matched to the desired aperture $D/2f$ so that for a beam in vacuo incident under the limiting angle $\theta_m$.

$$f_n = \frac{D}{2f} = \sin\theta_m = n_1 \cos\theta_{cr} = n_1 \sqrt{1 - \sin^2\theta_{cr}} = \sqrt{n_1^2 - n_2^2}$$

For example, the aperture $D/2f = 1$ is matched for $n_1 = 1.8$ and $n_2 = 1.5$. For light wavelengths much smaller than the fiber diameter, we can assume that simple geometrical optics is valid. Under these conditions, light incident at angles within the field of view will pass, whereas that coming from outside the aperture or from the housing walls outside the tube window will be absorbed (with the exception of certain skew rays which will be discussed presently). Stated differently, since the fiber bundle at its low temperature emits only a negligible amount of thermal radiation, the front end of the retina obtains light to a large extent only from the observed scene. Thus a nearly ideal iris effect is created: each image element is individually and completely shielded and differences or shading of temperature on the retina due to vignetting are avoided. Of course, a source of shading is still present, if the heat conductivity of the fiber material is too low. However, for a heat conductivity of 0.01 cal/sec deg cm, in arsenic trisulfide, the temperature difference on the retina may be only $10^{-3}$C.

As noted above certain "skew" rays are able to pass through the filaments at angles larger than $\theta_m$. However, they affect all elements equally, and their total effect is small or can be made small by choosing the fiber and its cladding material so as to discriminate against such rays. Finally, if desired, use can be made of the mode restriction according to electromagnetic waveguide theory; i.e. the diameter of the fiber is between $\lambda$ and $\lambda/2$, where $\lambda$ is the wavelength of the radiation.

As the radiation flux leaves an individual fiber, its original diameter will increase at the distance $d$ of the retina, first, because of diffraction by an amount $1.22d$ and second, due to the reflection limit by an amount $$2d \sqrt{4f \frac{2}{n} - 1}.$$

Thus if the retina is placed 0.1 mm from the bundle, the resolvable element size will be on the order of 10.1 mm for $f1$. It is possible, however, to place the retina considerably closer to the fibers, e.g. by placing an aluminum oxide film on a thermally insulating film of smoke or by other means to be discussed later, and then the spreading of the rays may be ignored.

The original image formed by the external optical system on the front end of the fiber bundle may be located quite closely to the tube window. Thus it is possible to employ relatively conventional and inexpensive optical equipment, in contrast to the recessed retina arrangement which has been used so far in thermal imaging tubes.

A further feature, also shown in FIG. 3 is made possible by the splitting up of the image into individual beams. Many types of nonuniformity in area detectors involve a gradual change of sensitivity over the surface. That is, the sensitivity difference between two points separated by many elements may be quite large, but those between two adjacent elements will be quite small. If opaque fibers 33 are used to separate the transparent ones, a reference level is provided between each pair image elements. The output signal can then be processed to provide only the difference between the retinal response as the electron beam moves from an illuminated area to a dark area. Assume that the response in a given region of the retina is especially high. Ordinarily the signal from this area would yield large signals, larger than from some other region which may in fact correspond to less incident energy. The mixed fiber system avoids this anomaly by comparing the signals under nearly equal conditions of sensitivity. Thus, if in an uncompensated retina the signal current fluctuates 5% because of nonuniformity, in the present case the fluctuation amounts only to 5% of the difference between adjacent elements signals. It may be preferable to arrange the opaque fibers with smaller diameters (by a factor of 2 or 3) than their transparent neighbors. First, the active area is increased thereby; second the "effective" temperature under the opaque areas is then more nearly equal to that of those which are illuminated. It should be stressed that the desired effects may be obtained even if the opaque fiber diameter is smaller (up to a limit) than the element resolvable either by the thermal distribution or the scanning beam.

Figure 5:
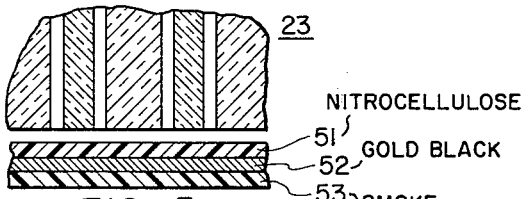
FIGS. 5 – 8 show several edge views of possible compositions of the retina 26 from FIG. 2.
Figure 6:
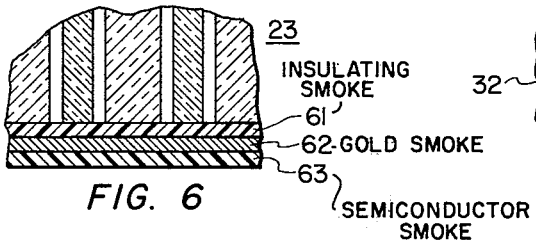
Figure 7:
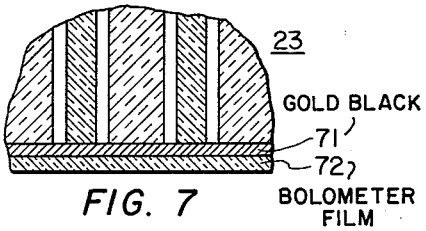

FIGS. 5–7 show three types of bolometric retinas that may be used to sense the thermal distribution or image. In FIG. 5 the retina is mounted in parallel spaced relationship (less than 0.1 mm spacing) with the image resolving plane presented by the ends of the fibers furthest from the lens system. It may consist for example, of a layer 51 of nitrocellulose covered with an electrically conductive layer 52 of gold black on which is superposed a layer 53 of semiconducting smoke. Smoke is a fluffy material produced by evaporating a selected material in an atmosphere of inert gas at reduced pressure, e.g. 10 microns of mercury. A typical semiconductor for this purpose arsenic triselenide. Gold black is a similar material where gold is the selected material.

The retina of FIG. 6 is deposited directly on the fiber optic bundle. A layer 61 of insulating smoke, e.g. antimony trisulfide is coated on the end of the fibers followed by a layer of gold black and the bolometric layer 63 of semiconducting smoke. The insulating smoke layer, like the nitrollulose layer in FIG. 5, serves as an electrical and heat insulator to prevent lateral image degradation. The gold black provides an electrical conductor, as in FIG. 5, to receive the electron scanning current.

The insulating smoke is deleted from the FIG. 7 retina. The gold black layer 71 in this case has a twofold purpose. First, it provides for the absorption of the incident infrared radiation converting it into a temperature pattern and second, it serves as a partial thermal insulator. But it is also an electrical and thermal conductor, although as such more than a thousand times less effective than the solid material. Unavoidably there results a reduction in the temperature profile, but this fact is at least partially compensated by a number of advantages: (1) lateral heat degradation is reduced, (2) the time constant is decreased; and (3) the lower mean temperature attainable makes possible the use of a more effective bolometer film 72, such as arsenic triselenide. Thus the resulting higher resolution, reduction of nonuniformities, and applicability of new materials more than make up for the loss in temperature signal.

Figure 8:
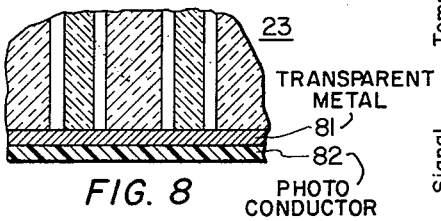
Figure 4:
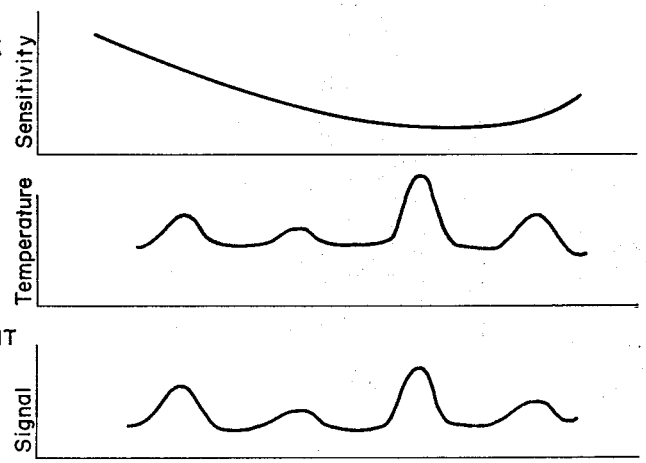
FIG. 4 shows a series of typical response curves keyed to the structure in FIG. 3.

As shown in FIG. 8 the fiber-optic system is also applicable to direct photoconductive processes. In this case, no thermal insulation is necessary. A thin metal film 81 on the back of the fiber bundle, transparent to far infrared is followed by a film 82 which exhibits a change of electrical conductivity in response to incident infrared radiation. This arrangement, then, operates as a vidicon in the far infrared, with the difference from existing tubes that the necessary low temperature can be obtained without the drawbacks in the optical arrangement mentioned above, and with the incorporation of a discrimination system for nonuniformities.

Many variations of the above described structures will be immediately apparent to those skilled in the art, but the present invention is limited only as defined in the claims which follow.

1. In a far infrared image converter with a lens system defining an image plane a photosensitive element comprising:

a bundle of optical fibers each having a first end face in said image plane and a second end face in a resolving plane; and a single continuous planar electrical heat detecting retina mounted in parallel relationship to said resolving plane and spaced less than 0.1 mm from all of said second end faces.

2. A converter according to claim 1 wherein:

at least a portion of said fibers are transparent to far infrared and coated with a material having a coating with index of refraction $n_2$ related to the index of refraction $n_1$ of the fiber by the relation $\sin \theta_m = \sqrt{n_1^2 - n_2^2}$, where $\theta_m$ is the half angle of view of said lens system.

3. A converter according to claim 1 wherein said bundle contains:

a first plurality of fibers transparent to far infrared; and a second plurality of fibers opaque to far infrared, said opaque fibers separating each of said transparent fibers.

4. A converter according to claim 1 wherein said retina comprises:

a layer of insulating material, transparent to IR, facing said end faces of said fibers; and a layer of smoke attached to said insulating layer.

5. A converter according to claim 1 wherein said retina comprises:

a layer of insulating smoke attached to the second end faces of said fibers;

a layer of gold black attached to said layer of smoke; and a layer of semi-conducting smoke attached to said layer of gold black.

6. A converter according to claim 1 wherein said retina comprises:

a layer of gold black attached to the second end faces of said fibers; and a layer of semiconducting smoke attached to said layer of gold black.

7. A converter according to claim 3 wherein:

said opaque fibers are smaller than said transparent fibers.

* * * * *